US009265135B2

(12) United States Patent
Auernhammer et al.

(10) Patent No.: US 9,265,135 B2
(45) Date of Patent: Feb. 16, 2016

(54) METHOD AND APPARATUS FOR HEATING CURRENT CONTROL OF A PULSED X-RAY TUBE

(71) Applicants: Rudolf Auernhammer, Ellingen (DE); Andreas Böhme, Nürnberg (DE); Johannes Walk, Buckenhof (DE)

(72) Inventors: Rudolf Auernhammer, Ellingen (DE); Andreas Böhme, Nürnberg (DE); Johannes Walk, Buckenhof (DE)

(73) Assignee: Siemens Aktiengesellschaft, München (DE)

( * ) Notice: Subject to any disclaimer, the term of this patent is extended or adjusted under 35 U.S.C. 154(b) by 210 days.

(21) Appl. No.: 14/151,591

(22) Filed: Jan. 9, 2014

(65) Prior Publication Data

US 2014/0192961 A1 Jul. 10, 2014

(30) Foreign Application Priority Data

Jan. 9, 2013 (DE) ..... 10 2013 200 189

(51) Int. Cl.
*H05G 1/34* (2006.01)
*H05G 1/30* (2006.01)
*H05G 1/26* (2006.01)

(52) U.S. Cl.
CPC ..... *H05G 1/34* (2013.01)

(58) Field of Classification Search
USPC ..... 378/105, 106, 110, 113, 199, 210
See application file for complete search history.

(56) References Cited

U.S. PATENT DOCUMENTS 5,748,701 A * 5/1998 Mika et al. ..... H01J 35/04 378/109

FOREIGN PATENT DOCUMENTS

DE 25 42 016 A1 3/1977
DE 43 00 825 A1 7/1994

OTHER PUBLICATIONS

German Office Action dated Sep. 18, 2013 for corresponding German Patent Application No. DE 10 2013 200 189.4 with English translation.

* cited by examiner

*Primary Examiner* — Bernard E Souw
(74) *Attorney, Agent, or Firm* — Lempia Summerfield Katz LLC

(57) ABSTRACT

A method and an associated apparatus for controlling a heating current flowing through an emitter of a pulsed X-ray tube during pulse pauses are provided. The heating current is controlled by comparing a measured actual value of the heating current with a predefinable desired value of the heating current. A low-pass filtering of the actual value of the heating current is effected before the comparison. A time constant of the low-pass filtering is equal to a thermal time constant of the emitter. A correction of the actual value of the heating current is provided before the low-pass filtering by a first correction value. The first correction value is determined such that a tube current control during the pulses is not compensated for by the heating current control in the pulse pauses.

20 Claims, 3 Drawing Sheets

METHOD AND APPARATUS FOR HEATING CURRENT CONTROL OF A PULSED X-RAY TUBE

This application claims the benefit of DE 10 2013 200 189.4, filed on Jan. 9, 2013, which is hereby incorporated by reference in its entirety.

FIELD

The present embodiments relate to a method and an apparatus for controlling a heating current flowing through an emitter of a pulsed X-ray tube during pulse pauses of radiation.

BACKGROUND

In order to control current of an X-ray tube, heating current of a cathode (e.g., an emitter) of the X-ray tube is varied. As a result, the electron emission of the cathode is controlled. Such control is described in the published patent application DE 43 00 825 A1.

In the case of pulsed radiography or in the case of 3D imaging in angiography, a dose power of X-ray radiation and thus a required tube current from pulse to pulse are adapted to a present object situation. For this purpose, an X-ray generator that heats the cathode to an emission temperature receives corresponding desired value stipulations for the tube current in each case shortly before the X-ray pulses. By virtue of emission tables stored in the X-ray generator, this results in an appropriate start value of the heating current. However, since typical pulse widths are only in the range of 3 to 12 ms, control only during the radiation pulses is ruled out. In the pulse pauses, too, the emitter is to be controlled to the required temperature for reasons of the desired function. Typical image frequencies are in the range of 3 to 100 Hz.

It is known, in the case of a desired value jump in the tube current, to select the corresponding heating current with the aid of an emission table and to adjust the heating current by a heating current controller that is responsible for controlling the heating current in the pulse pauses. On account of the thermal delay of the emitter, the tube current follows only in a time-delayed manner.

A tube current controller is active during a pulse, and the tube current controller provides feedback about the present emitter temperature directly via the measurement of the tube current in the high-voltage circuit. The tube current controller may attempt to bring the emitter to the required temperature as rapidly as possible by a large control dynamic range within the allowed limits for the heating current. This functions very effectively in the case of long X-ray pulses (e.g., greater than 10 ms), but in the case of short pulses (e.g., 3 ms), the influencing possibility for the tube current controller decreases greatly owing to the short control time. Consequently, owing to a lack of emission feedback, the more sluggish heating current controller dominates the emitter temperature or the rate of adjustment thereof. Faster tube current adjustment times are to be provided, however, owing to faster rotation times, higher image frequencies and shorter pulse times in the case of 3D imaging.

FIG. 1 shows a block diagram of known heating current control of one embodiment of an X-ray tube 1 operating in pulsed operation. In this case, according to the design, during the pulse pauses, the heating current H is controlled based on stored emission tables with the aid of the measured actual value of the heating current $H_{Actual}$, and during the X-ray pulses, the heating current H is controlled with the aid of the measured actual value of the tube current $R_{Actual}$. The X-ray tube 1 includes at least one emitter 2 and at least one anode 3. The at least one emitter 2 is supplied with the heating current H from the controllable current supply 4. The tube voltage is generated by a controllable tube high-voltage supply 5.

A heating current measuring unit 6 is situated in the heating current circuit and determines the actual value of the heating current $H_{Actual}$. The actual value of the heating current $H_{Actual}$ is fed to a heating current control unit 8. A tube current measuring unit 7 is situated in the tube voltage circuit and determines the actual value of the tube current $R_{Actual}$. The actual value of the tube current $R_{Actual}$ is likewise fed to the heating current control unit 8. The actual values $H_{Actual}$ and $R_{Actual}$ are compared with the desired value of the heating current $H_{Desired}$ in the pulse pauses and with the desired value of the tube current $R_{Desired}$ during the pulses in the heating current control unit 8. A controlled variable RG is derived therefrom as necessary and controls the current supply 4. The heating current control unit 8 is embodied as a PI controller, for example.

FIG. 2 shows a timing diagram of relevant variables of the heating current control. This diagram is appropriate with respect to the heating current control in FIG. 1. The control during the pulses is not illustrated for reasons of clarity. Such additional control would become apparent as heating current peaks during the pulses and adjust the tube current to the desired value somewhat more rapidly.

The illustration shows on the x-axis the time t in milliseconds, and on the y-axis merely phenomenologically (without indications of magnitude) the actual value of the tube current $R_{Actual}$, the desired value of the tube current $R_{Desired}$, the temperature T of the emitter 2 and the actual value of the heating current $H_{Actual}$. Owing to a material-governed delayed heating of the emitter 2, the temperature T does not rise abruptly, but rather in a time-delayed manner. As a result, the actual value of the tube current $R_{Actual}$ attains the desired value $R_{Desired}$ only after approximately 500 ms. In the example illustrated, the pulse widths and pulse pauses in each case have a length of approximately 75 ms.

A dynamic correction that adapts the heating current H in the pulse pauses if the tube current R deviates from the nominal value during a pulse would accelerate the adjustment, but also leads to overshoots and undershoots beyond the actual desired operating point. In the case of limit-load scans, this may lead to an overload of the X-ray tube and thus to arcing. This causes unusable 3D scans and may also lead to damage to the X-ray emitter.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a method and an apparatus for the heating current control of a pulsed X-ray tube that control the heating current and thus the tube current to a wanted desired value more rapidly and more accurately are provided.

Registered instantaneously flowing heating current is filtered by a low-pass filter. A time constant of the low-pass filter is chosen to be equal to an emitter time constant. A heating current controller attempts to adjust the low-pass-filtered signal as rapidly as possible, subjects the emitter to overcurrent or undercurrent in a targeted manner, and thus adjusts the emitter to the desired temperature more rapidly. When expressed in a simplified way, the heating current controller receives as feedback a fictitious temperature, which the heating current controller adjusts more rapidly than if the temperature settled via the thermal time constant of the emitter.

One or more of the present embodiments provide a method for regulating a heating current, flowing through an emitter, of a pulsed X-ray tube during pulse pauses. The method includes comparing a measured actual value of the heating current with a predefinable desired value of the heating current. A low-pass filtering of the actual value of the heating current is effected before the comparison with a time constant equal to the thermal time constant of the emitter. The method includes a correction of the actual value of the heating current before the low-pass filtering by a first correction value. The first correction value is determined such that a tube current control during the pulses is not compensated for by the heating current control in the pulse pauses, in order to obtain a prognosis of the emitter temperature as an actual variable for a control. One or more of the present embodiments afford the advantage, as a result of an emitter temperature simulation by low-pass filtering and an observation of the X-ray current control, of establishing an optimized control loop with an improved adjustment characteristic after a desired value jump, which also avoids an overshoot.

In one development, the first correction value is determined from the difference between the actual value of the heating current and an actual value of the heating current at the beginning of a present pulse.

In a further embodiment, the first correction value is subtracted from the actual value of the heating current.

In a further embodiment, the method includes a correction of the actual value of the heating current before the low-pass filtering by a second correction value, which is determined from a model of electron cooling during the pulses.

In one embodiment, the second correction value is determined such that thermal cooling caused by the electron cooling during the pulses is not registered.

The second correction value is subtracted from the actual value of the heating current.

In a further embodiment, the method includes a correction of the actual value of the heating current before the low-pass filtering by a third correction value that is determined from a model of anode back heating.

In one development, the third correction value is subtracted from the actual value of the heating current.

One or more of the present embodiments also provide an apparatus for controlling a heating current, flowing through an emitter, of a pulsed x-ray tube during pulse pauses. The apparatus includes a heating current control unit configured to control the heating current by comparing a measured actual value of the heating current with a predefinable desired value. The apparatus also includes a first low-pass filter unit that is connected upstream of the heating current control unit and has a time constant equal to the thermal time constant of the emitter and is configured to filter the actual value of the heating current before the comparison. The apparatus also includes a first correction unit configured to alter the actual value of the heating current before the low-pass filtering by a first correction value and to determine the first correction value such that a tube current control during the pulses is not compensated for by the heating current control unit in the pulse pauses.

In one development, the first correction unit is configured to determine the first correction value from the difference between the actual value of the heating current and the actual value of the heating current at the beginning of the present pulse.

In one embodiment, the apparatus includes a summing unit connected upstream of the low-pass filter unit and is configured to subtract the first correction value from the actual value of the heating current.

In a further embodiment, the apparatus includes a second correction unit configured to alter the actual value of the heating current before the low-pass filtering by a second correction value and to determine the second correction value from a model of electron cooling during the pulses.

In one embodiment, the second correction unit may be embodied as a second low-pass filter unit. A time constant of the second low-pass filter unit is equal to a time constant of the electron cooling.

In one development, the summing unit is configured to subtract the second correction value from the actual value of the heating current.

The apparatus may include a third correction unit configured to alter the actual value of the heating current before the low-pass filtering by a third correction value, and to determine the third correction value from a model of anode back heating.

In a further embodiment, the summing unit is configured to subtract the third correction value from the actual value of the heating current.

One or more of the present embodiments also provide an x-ray generator including an apparatus described above.

DETAILED DESCRIPTION

Figure 3:
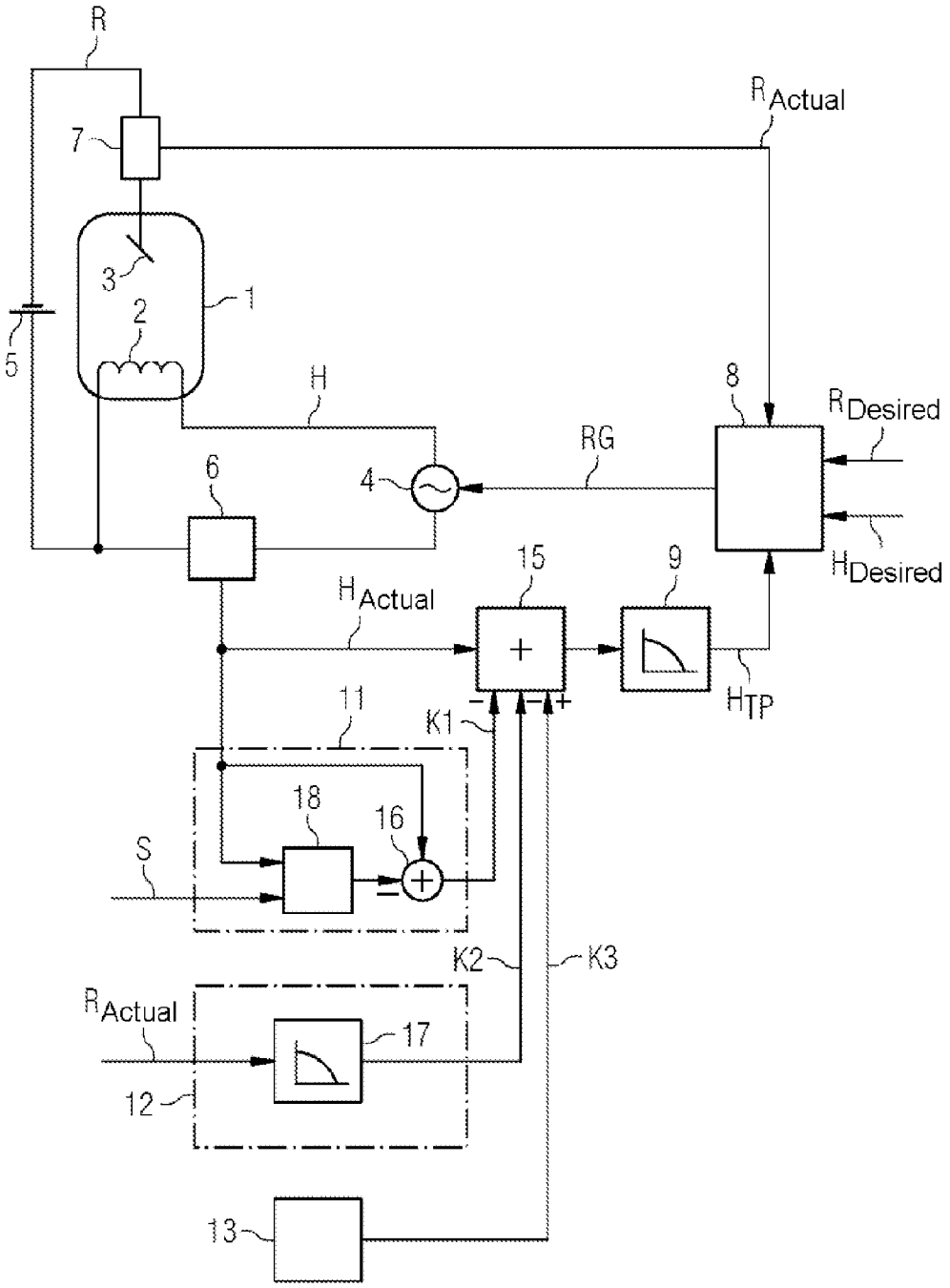
FIG. 3 shows a block diagram of an exemplary heating current control with low-pass filtering.

FIG. 3 shows a block diagram of one embodiment of a heating current control of an X-ray tube 1 operating in pulsed operation with a low-pass filtering of an actual value of a heating current $H_{Actual}$. During the pulse pauses, the heating current H is controlled based on stored emission tables with the aid of the measured actual value of the heating current $H_{Actual}$. During the X-ray pulses, the heating current H is controlled with the aid of the measured actual value of the tube current $R_{Actual}$.

The X-ray tube 1 includes an emitter 2 (cathode) and an anode 3. The emitter 2 is supplied with the heating current H from the controllable current supply 4. The tube voltage is generated by a controllable tube high-voltage supply 5.

A heating current measuring unit 6 is situated in the heating current circuit and determines the actual value of the heating current $H_{Actual}$. The actual value of the heating current $H_{Actual}$ is filtered by a first low-pass filter unit 9 and fed as low-pass-filtered actual value of the heating current $H_{TP}$ to the heating current control unit 8. A time constant (e.g., approximately 100 ms to 500 ms) of the first low-pass filter unit 9 is chosen to be equal to a thermal time constant of the emitter 2.

The low-pass-filtered actual value of the heating current $H_{TP}$ thus corresponds to a fictitious emitter temperature, but not to the instantaneously flowing heating current H during the thermal settling. In the case of a heating current control unit 8 (e.g., embodied as a PI controller), a boosting or lowering of the heating current H beyond the final steady-state value arises as a result of the low-pass filtering. As a result of this, an improved performance is obtained compared with known solutions. In order to rule out damage to the emitter 2, however, the heating current H is upwardly limited to a maximum value permitted for the emitter 2.

A tube current measuring unit 7 is situated in the tube high-voltage circuit and determines the actual value of the tube current $R_{Actual}$. The actual value of the tube current $R_{Actual}$ is likewise fed to the heating current control unit 8. The actual value of the heating current $H_{Actual}$ and the actual value of the tube current $R_{Actual}$ are compared with the desired value of the heating current $H_{Desired}$ in the pulse pauses and with the desired value of the tube current $R_{Desired}$ during the pulses in the heating current control unit 8. A controlled variable RG is derived therefrom and controls the current supply 4.

The heating current control optimized in this way has a faster adjustment performance after a desired value change and manages without additional hardware. A dynamic correction that supports the adjustment process may be attenuated and activated in a time-delayed manner after the desired value jump. The known over- and undershooting is avoided. The heating current control unit 8 manages without the information about the length of the pulse pauses.

The described low-pass filtering of the actual value of the heating current $H_{Actual}$ has the following effect, however. Since the tube current control intervenes in the heating current H during the pulses in order to adapt the tube current R, this intervention will influence the low-pass-filtered actual value of the heating current $H_{TP}$ in the pulse pauses as well. If the desired value of the heating current $H_{Desired}$ is then not tracked after an intervention of the tube current control, the heating current control unit 8 will attempt to reverse the intervention of the tube current control and adjust the filtered actual value of the heating current $H_{TP}$ in accordance with a nominal value of the heating current $H_{TP}$. This has the consequence that the two controls operate virtually against one another, and, consequently, the next pulse does not become better than the preceding pulse. Instead of a correction of the desired value of the heating current $H_{Desired}$, the actual value of the heating current $H_{Actual}$ may also be corrected, which has the same effect.

According to one or more of the present embodiments, the control during the pulses is observed, and a first correction factor K1 is determined for the heating current control in the pulse pauses. Without the first correction factor K1, no adjustment occurs. Since the intervention of a tube current control does not permanently influence the emitter 2, the first correction factor K1 is likewise filtered with the emitter time constant and will slowly decline during the pulse pauses.

The first correction unit 11 provided for this purpose includes a storage unit 18 that is triggered by the pulses of the tube high-voltage supply 5 or by the start of the tube current control. The storage unit 18 has the actual value of the heating current $H_{Actual}$ present at its input and stores the value at the beginning of the present pulse for the rest of the pulse. This value is subtracted from the actual value of the heating current $H_{Actual}$ in an adder 16 during the pulse pauses. The first correction value K1 determined in this way is subtracted from the actual value of the heating current $H_{Actual}$ in the summing unit 15, which is situated in the path of the measured heating current.

A second correction value K2 is used to prevent a situation where a thermal cooling during the pulses owing to the electron cooling, which is compensated for during the tube current control, is registered by the observation of the tube current R and erroneously also conveyed as a correction factor to the heating current control unit 8 during the pulse pauses. According to one or more of the present embodiments, therefore, a second correction unit 12 that subtracts a second correction value K2 from the actual value of the heating current $H_{Actual}$ in the summing unit 15 is provided. In the second correction unit 12, a model of the electron cooling during the pulses is simulated, for example, by a second low-pass filter unit 17 that supplies the second correction value K2 for the pulse pauses.

The anode 3 may result in a back heating from the anode 3 to the emitter 2. This may be taken into account by a third correction value K3. For this purpose, a model of the anode back heating is created, and the third correction unit 13 is used to determine the third correction factor K3 for the heating current control in the pulse pauses. The third correction value K3 is added to the actual value of the heating current $H_{Actual}$ in the summing unit 15.

As necessary, further correction values may be determined and computationally included in the actual value of the heating current $H_{Actual}$ in the summing unit 15. Other equivalent circuit arrangements with a plurality of first low-pass filter units 9 may be provided.

Figure 4:
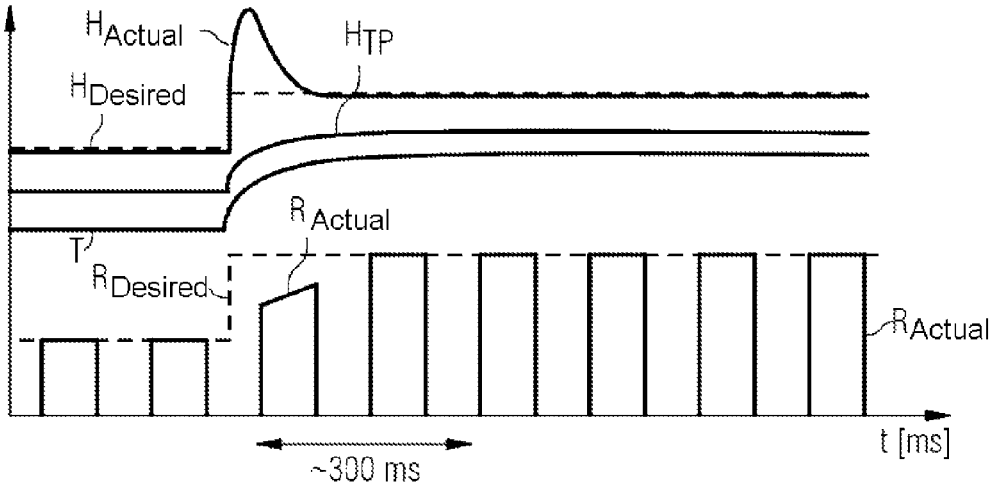
FIG. 4 shows a timing diagram of an exemplary heating current control with low-pass filtering.

FIG. 4 shows an exemplary timing diagram of relevant variables of the heating current control. The exemplary timing diagram is appropriate with respect to FIG. 3. The control during the pulses is not illustrated for reasons of clarity. Such additional control may become apparent as heating current peaks during the pulses and adjust the tube current R to the desired value $R_{Actual}$ more rapidly.

Figure 1:
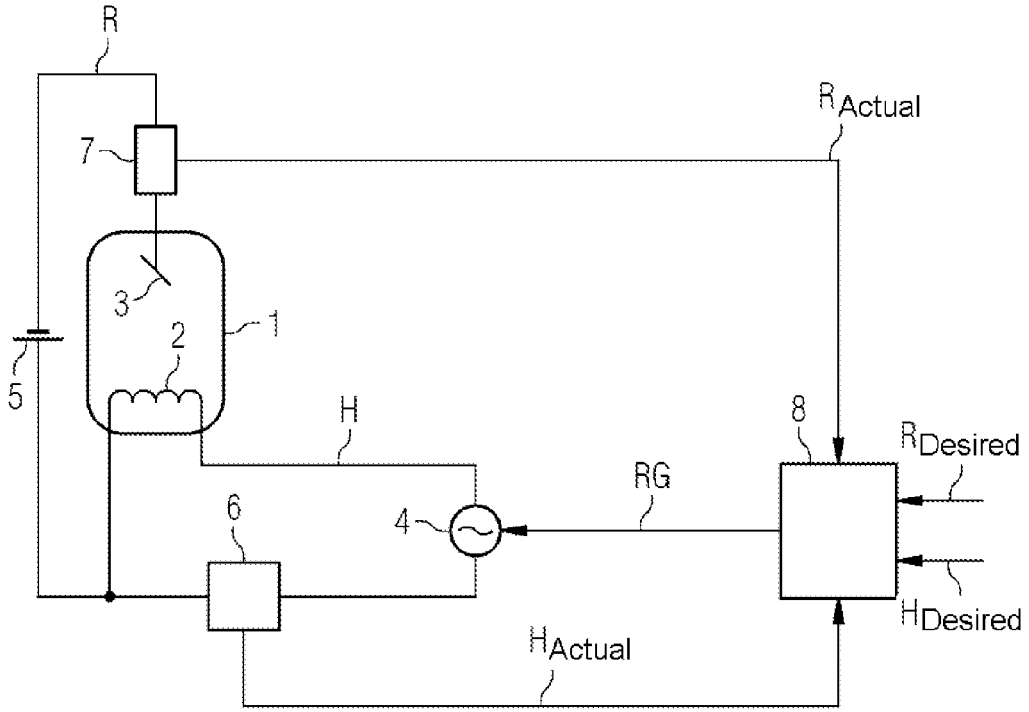
FIG 1 Prior art
FIG. 1 shows a block diagram of a heating current control in accordance with the prior art.
Figure 2:
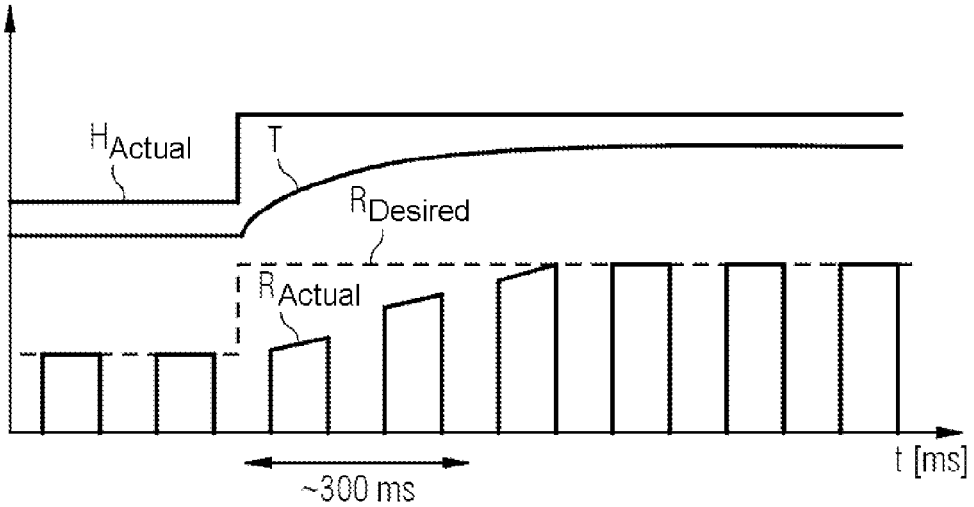
FIG 2 Prior art
FIG. 2 shows a timing diagram of a heating current control in accordance with the prior art.

The illustration shows on the x-axis the time t in milliseconds, and on the y-axis merely phenomenologically (e.g., without indications of magnitude) the actual value of the tube current $R_{Actual}$, the desired value of the tube current $R_{Desired}$, the temperature T of the emitter 2, the low-pass-filtered actual value of the heating current $H_{TP}$, the desired value of the heating current $H_{Desired}$ and the actual value of the heating current $H_{Actual}$. From the profile of the curves, in comparison with the control according to FIG. 2, the temperature T of the emitter 2 rises more rapidly, and the actual value of the tube current $R_{Actual}$ attains the desired value $R_{Desired}$ more rapidly (e.g., in approximately 250 ms). This primarily stems from the fact that the actual value of the heating current $H_{Actual}$ rises greatly above the desired value of the heating current $H_{Desired}$ in the first 100 ms owing to the low-pass filtering according to one or more of the present embodiments and falls to the desired value of the heating current $H_{Desired}$ only after approximately 400 ms. In the example illustrated, the pulse widths and pulse pauses in each case have a length of approximately 75 ms.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A method for controlling a heating current flowing through an emitter of a pulsed X-ray tube during pulse pauses, the method comprising:

comparing a measured actual value of the heating current with a predefinable desired value of the heating current;

low-pass filtering the measured actual value of the heating current before the comparison, wherein a time constant of the low-pass filtering is equal to a thermal time constant of the emitter; and correcting the measured actual value of the heating current before the low-pass filtering by a first correction value, wherein the first correction value is determined such that a tube current control during the pulses is not compensated for by the heating current control in the pulse pauses.

2. The method of claim 1, wherein the first correction value is determined from a difference between the measured actual value of the heating current and an actual value of the heating current at the beginning of a present pulse.

3. The method of claim 1, further comprising subtracting the first correction value from the measured actual value of the heating current.

4. The method of claim 1, further comprising correcting the measured actual value of the heating current before the low-pass filtering by a second correction value, the second correction value being determined from a model of electron cooling during the pulses.

5. The method of claim 4, wherein the second correction value is determined such that thermal cooling caused by the electron cooling during the pulses is not registered.

6. The method of claim 4, further comprising subtracting the second correction value from the measured actual value of the heating current.

7. The method of claim 4, further comprising correcting the measured actual value of the heating current before the low-pass filtering by a third correction value, the third correction value being determined from a model of anode back heating.

8. The method of claim 7, further comprising adding the third correction value to the measured actual value of the heating current.

9. An apparatus for controlling a heating current flowing through an emitter of a pulsed X-ray tube during pulse pauses, the apparatus comprising:

a heating current control unit configured to control the heating current by comparing a measured actual value of the heating current with a predefinable desired value;

a first low-pass filter unit that is connected upstream of the heating current control unit and comprises a time constant equal to a thermal time constant of the emitter, wherein the first low-pass filter is configured to filter the measured actual value of the heating current before the comparison; and a first correction unit configured to:

alter the measured actual value of the heating current before the low-pass filtering by a first correction value K1; and determine the first correction value such that a tube current control during the pulses is not compensated for by the heating current control unit in the pulse pauses.

10. The apparatus of claim 9, wherein the first correction unit is further configured to determine the first correction value from a difference between the measured actual value of the heating current and an actual value of the heating current at the beginning of a present pulse.

11. The apparatus of claim 9, further comprising a summing unit that is connected upstream of the first low-pass filter unit and is configured to subtract the first correction value from the measured actual value of the heating current.

12. The apparatus of claim 9, further comprising a second correction unit configured to:

alter the measured actual value of the heating current before the low-pass filtering by a second correction value; and determine the second correction value from a model of electron cooling during the pulses.

13. The apparatus of claim 12, wherein the second correction unit comprises a second low-pass filter unit, a time constant of the second low-pass filter unit being equal to a time constant of the electron cooling.

14. The apparatus of claim 11, wherein the summing unit is configured to add the second correction value to the measured actual value of the heating current.

15. The apparatus of claim 12, further comprising a third correction unit configured to:

alter the measured actual value of the heating current before the low-pass filtering by a third correction value; and determine the third correction value from a model of anode back heating.

16. The apparatus of claim 15, wherein the summing unit is configured to subtract the third correction value from the measured actual value of the heating current.

17. An X-ray generator comprising:

an apparatus for controlling a heating current flowing through an emitter of a pulsed X-ray tube during pulse pauses, the apparatus comprising:

a heating current control unit configured to control the heating current by comparing a measured actual value of the heating current with a predefinable desired value;

a first low-pass filter unit that is connected upstream of the heating current control unit and comprises a time constant equal to a thermal time constant of the emitter, wherein the first low-pass filter is configured to filter the measured actual value of the heating current before the comparison; and a first correction unit configured to:

alter the measured actual value of the heating current before the low-pass filtering by a first correction value K1; and determine the first correction value such that a tube current control during the pulses is not compensated for by the heating current control unit in the pulse pauses.

18. The X-ray generator of claim 17, wherein the first correction unit is further configured to determine the first correction value from a difference between the measured actual value of the heating current and an actual value of the heating current at the beginning of a present pulse.

19. The X-ray generator of claim 17, wherein the apparatus further comprises a summing unit that is connected upstream of the first low-pass filter unit and is configured to subtract the first correction value from the measured actual value of the heating current.

20. The X-ray generator of claim 17, wherein the apparatus further comprises a second correction unit configured to:

alter the measured actual value of the heating current before the low-pass filtering by a second correction value; and determine the second correction value from a model of electron cooling during the pulses.

* * * * *